US007319768B2

(12) United States Patent
van Oerle

(10) Patent No.: US 7,319,768 B2
(45) Date of Patent: Jan. 15, 2008

(54) HEARING AID AND METHOD FOR THE DETECTION AND AUTOMATIC SELECTION OF AN INPUT SIGNAL

(75) Inventor: Gerard van Oerle, Uster (CH)

(73) Assignee: Phonak AG, Stafa (CH)

( * ) Notice: Subject to any disclaimer, the term of this patent is extended or adjusted under 35 U.S.C. 154(b) by 642 days.

(21) Appl. No.: 10/801,785

(22) Filed: Mar. 16, 2004

(65) Prior Publication Data

US 2005/0207602 A1 Sep. 22, 2005

(51) Int. Cl.
*H04R 25/00* (2006.01)

(52) U.S. Cl. ..... 381/312; 381/92; 381/331

(58) Field of Classification Search ..... 381/312, 381/313, 320, 321, 331, 91, 92, 122, 123, 381/111; 379/443, 52
See application file for complete search history.

(56) References Cited

U.S. PATENT DOCUMENTS 4,596,902 A 6/1986 Gilman
6,028,946 A * 2/2000 Jahne ..... 381/122
2003/0223592 A1 12/2003 Deruginsky et al.

FOREIGN PATENT DOCUMENTS

DE 10146886 A1 4/2003
EP 1367857 A1 12/2003

OTHER PUBLICATIONS

European Search Report, EP04405158, Feb. 17, 2005.

* cited by examiner

*Primary Examiner*—Huyen Le
(74) *Attorney, Agent, or Firm*—Pearne & Gordon LLP

(57) ABSTRACT

A method for detecting and automatically selecting an input signal in a hearing aid in which at least two analog input signals are available, comprises the steps of analyzing the analog input signals and detecting, for each analog input signal, whether it comprises a relevant signal, selecting, according to results of said analysis, at least one selected input signal that comprises a relevant signal for further processing, and controlling a signal routing means to selectively route each one of the at least one selected input signals to further processing means.

A hearing aid according to the invention comprises means to perform the above method.

12 Claims, 2 Drawing Sheets

HEARING AID AND METHOD FOR THE DETECTION AND AUTOMATIC SELECTION OF AN INPUT SIGNAL

FIELD OF THE INVENTION

The invention relates to the field of hearing devices or hearing aids. It relates in particular to a hearing aid with detection and automatic selection of an input signal and a method for detecting and automatically selecting an input signal in a hearing aid.

BACKGROUND OF THE INVENTION

The term "hearing aid", "hearing instrument" or "hearing device", as understood here, denotes on the one hand hearing aid devices that are therapeutic devices improving the hearing ability of individuals, primarily according to diagnostic results. Such hearing aid devices may be Outside-The-Ear hearing aid devices or In-The-Ear hearing aid devices. On the other hand, the term stands for devices which may improve the hearing of individuals with normal hearing e.g. in specific acoustical situations as in a very noisy environment or in concert halls, or which may even be used in context with remote communication or with audio listening, for instance as provided by headphones.

The hearing devices addressed by the present invention are so-called active hearing devices which comprise at the input side at least one acoustical to electrical converter, such as a microphone, at the output side at least one electrical to mechanical converter, such as a loudspeaker, and which further comprise a signal processing unit for processing signals according to the output signals of the acoustical to electrical converter and for generating output signals to the electrical input of the electrical to mechanical output converter. In general, the signal processing circuit may be an analog, digital or hybrid analog-digital circuit, and may be implemented with discrete electronic components, integrated circuits, or a combination of both.

Many hearing aids comprise more than one microphone in order to allow directional hearing. They may also have additional signal sources such as telecoils, audio input lines and wireless receivers for amplitude or frequency modulated (AM or FM) signals. In order to automatically select a signal source that is appropriate for the user's current hearing situation, various approaches exist: Telecoils and the processing of telecoil signals are e.g. activated by a reed relay that is operated by a small magnet attached to a telephone receiver as described in DE 31 09 049 C2. Audio input processing may be enabled by a contact which is mechanically activated when a corresponding input device such as an audio shoe is attached to the hearing aid.

In order to eliminate the need for dedicated electromechanical devices, DE 101 46 886 proposes to constantly digitise audio signals from two potential signal sources. The digitised signals are analysed by a classification algorithm running on a digital signal processor (DSP), resulting in an indication which signal may carry relevant acoustic information. The respective signal or a mixture of signals is then fed to the output speaker.

An important design criterion for components of hearing devices is the electric power consumption.

DESCRIPTION OF THE INVENTION

It is therefore an object of the invention to create a hearing aid with detection and automatic selection of an input signal and a method for detecting and automatically selecting an input signal in a hearing aid of the type mentioned initially, which provide for an automatic selection among a plurality of signal sources while minimising power consumption of the associated means.

A hearing aid with detection and automatic selection of an input signal according to the invention comprises at least two analog input signal sources, at least one analog-to-digital converter for generating, from an analog input signal, a corresponding digital input signal, and further processing means for digital processing of input signals. The hearing aid further comprises input signal routing means for selectively routing each one of one or more selected input signals to the further processing means, and signal detection means configured to analyse the analog input signals and to control the signal routing means according to results of said analysis.

A method according to the invention, for detecting and automatically selecting an input signal in a hearing aid in which at least two analog input signals are available, comprises the steps of

- analysing the analog input signals and detecting, for each analog input signal, whether it comprises a relevant signal,
- selecting, according to results of said analysis, at least one selected input signal that comprises a relevant signal for further processing, and
- controlling a signal routing means to selectively route each one of the at least one selected input signals to further processing means.

Since the analog input signals are analysed, it is not necessary to constantly perform an analog-to-digital (A/D) conversion and a digital signal analysis on the DSP for each input signal source. This results in a reduced consumption of electric power. Signal analysis is done without generating a digital multilevel or high resolution representation of the input signal.

In a further preferred embodiment of the invention, if a relevant signal is detected in a first analog input signal, then an A/D converter is configured to digitise said first analog input signal and transmit the digitised signal for further processing. Said A/D converter is either an A/D converter that was powered down and is activated to convert said first analog input signal, or an A/D converter that was used to convert another analog input signal and is switched over to analyse the first analog input signal instead.

In both the above cases (switching on a converter or switching over to an active converter), power consumption is reduced as long as no signal is detected. In the second case, the number of circuit components in the hearing aid is also reduced, i.e. the complexity of an integrated circuit based solution is decreased. The same holds for analog signal conditioning means such as pre-amplification prior to the A/D conversion, which may also be powered down or up or switched from one input source to another, respectively.

In the first of the above cases, the digitised input signal corresponding to the newly detected analog signal may be analysed and classified in the DSP or in any other appropriate processing means such as a microcontroller or custom integrated circuit in order to verify whether it should be provided to the user. In this way, the flexibility and sophistication of classification algorithms that may be implemented on the DSP are obtained.

In a preferred embodiment of the invention, a hearing aid further comprises a signal detection means configured to analyse a single signal, and a further input multiplexer for alternately selecting one of the analog input signals and feeding it to the signal detection means in turn. As a result, as only one detection means is required, the power consumption and the number of components (i.e. circuit complexity) is further reduced.

In another preferred embodiment of the invention, the signal detection means is configured to indicate the presence of a relevant signal in an input signal if the amplitude of the input signal exceeds a predetermined amplitude threshold during a predetermined minimum time within a predetermined time window. The amplitude threshold may optionally be dynamically adapted in accordance with user feedback and/or with the signal classification performed by the digital signal processing means. For example, if the signal detection means repeatedly reports the presence of a signal which is then rejected by the signal processing means, then the amplitude threshold can be increased.

This approach allows a simple and low-power implementation of a detection circuit and method. A digital signal processor is not required, and yet all of the input signals can be analysed for the presence of a relevant signal. The approach works equally well for two or more signal sources.

For more than two signal sources it is, in principle, possible to have more than one input signal comprising a relevant signal, and to select more than one of them as selected input signals. Each of these selected input signals is associated with one A/D converter, either by powering on the converter or by routing or feeding the input signal to the converter. The DSP is then configured to combine the several digitised input signals.

The invention is preferably practiced in order to switch from a microphone input to a telecoil and/or wireless receiver input or to a combined signal generated from the microphone and telecoil and/or wireless receiver inputs.

The input signal detection means of the present invention can furthermore be used to automatically control the operational mode of the entire hearing aid in order to minimise electric power consumption. For example, if the detection means does not detect any relevant acoustic signals on any of the multiple sources (i.e. microphones, telecoil, audio input or wireless receiver, etc.) the hearing aid is automatically put into sleep mode. In such a sleep mode all circuitry associated with audio signal processing—especially the DSP, audio signal converters and transducers, which constitute the major fraction of power consumption—is switched off, i.e. deactivated, thus reducing the electric power consumption of the hearing aid to a minimum. As soon as the input signal detection means senses relevant acoustic signals on one of the multiple inputs, the audio signal processing path is reactivated ("woken up" from sleep mode), i.e. the device is restored to its normal operational mode. This wake-up functionality regarding the audio signal processing in its entirety (which does not comprise the detection means) may be implemented independently from the selection of individual signal sources.

Further preferred embodiments are evident from the dependent patent claims. Features of the device claims may be incorporated into the method claims and vice versa.

BRIEF DESCRIPTION OF THE DRAWINGS

The subject matter of the invention will be explained in more detail in the following text with reference to preferred exemplary embodiments which are illustrated in the attached drawings, in which.

The reference symbols used in the drawings, and their meanings, are listed in summary form in the list of reference symbols. In principle, identical parts are provided with the same reference symbols in the figures.

DETAILED DESCRIPTION OF PREFERRED EMBODIMENTS

Figure 1:
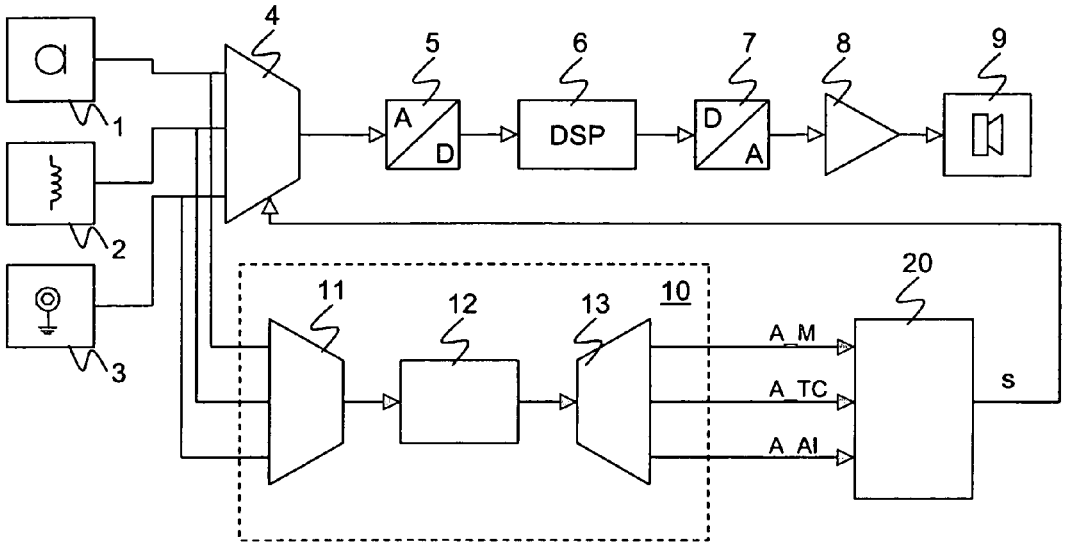
FIG. 1 schematically shows a signal flow structure of a hearing aid according to the invention.

FIG. 1 schematically shows a block diagram with a signal flow structure of a hearing aid according to a preferred embodiment of the invention. The hearing aid comprises a plurality of analog input signal sources, each providing an analog input signal. Such sources are, for example one or more microphones 1, a telecoil 2 and an audio input 3. The telecoil 2 or T-coil receives signals inductively from a telephone speaker or from a coil installed in a building. The audio input 3 may receive signals e.g. from a wire connection or from a wireless receiver. Each of the input signal sources may comprise dedicated signal conditioning means. A multiplexer 4 is configured to select one of the input signals and to route or connect it, optionally via a preamplifier, to an A/D converter 5 which generates a corresponding digital signal and transmits it to a digital signal processor 6. The digital signal processor 6 processes one or more incoming audio signals in accordance with the needs of the user and generates a digital output signal that is converted by a D/A converter 7 and output via an output amplifier 8 and a speaker 9.

The input signals are also transmitted to a "sniffer" circuit 10 which detects whether a specific input signal comprises a relevant signal, that is, whether a signal component carrying information for the user is present in the input signal.

In a preferred embodiment of the invention, the sniffer circuit 10 comprises a single detection circuit 12 and a further multiplexer 11 for selecting the input signal to be analysed, and a synchronised demultiplexer 13 for controlling binary signal lines, each of which represents the detection of a relevant input signal on a corresponding input line. The binary signals A_M, A_TC, A_AI are processed by a selection logic 20 for selecting which of the analog input devices 1, 2, 3 is to be connected by the multiplexer 4 to the A/D converter 5. The selection logic 20 transmits a corresponding control signal s to the multiplexer 4.

In another preferred embodiment of the invention, the hearing aid comprises a second A/D converter connected to the digital signal processor 6, and a second multiplexer configured to connect one of several input sources to the second A/D converter. This allows to select two input signals for further processing by the digital signal processor 6. Said further processing may include combining or "mixing" of the input signals.

In yet another preferred embodiment of the invention, the second A/D converter is permanently associated with one signal input, e.g. a microphone, and the multiplexer 4 and sniffer circuit 10 are configured to choose among the remaining input signal sources.

Figure 2:
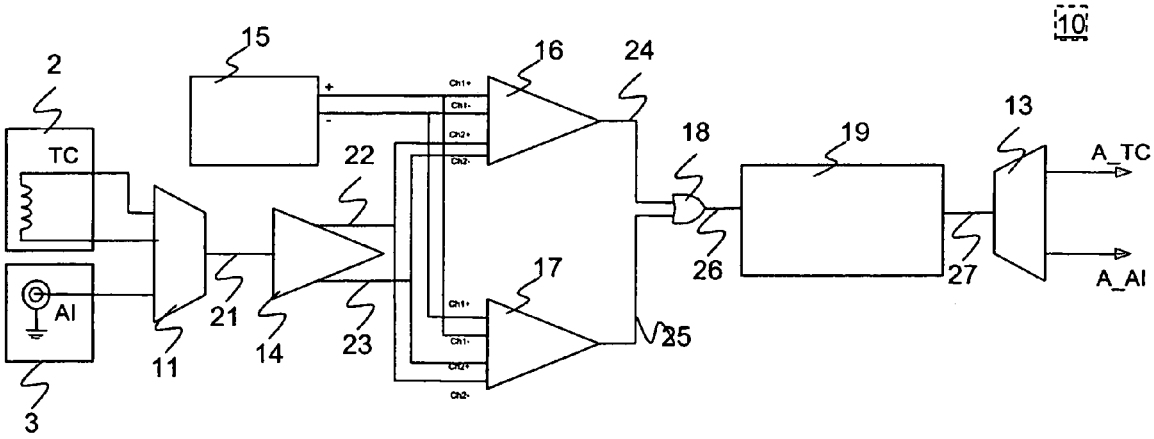
FIG. 2 schematically shows a structure of a signal detection means according to the invention.

FIG. 2 schematically shows a structure of a signal detection means according to the invention. In this example, the further multiplexer 11 has only two inputs, i.e. one from a telecoil 2 and one from an audio input 3. The further multiplexer 11 alternately selects one of said inputs for a suitable period of time that is sufficiently long to detect a signal activity on the input.

Figure 3:
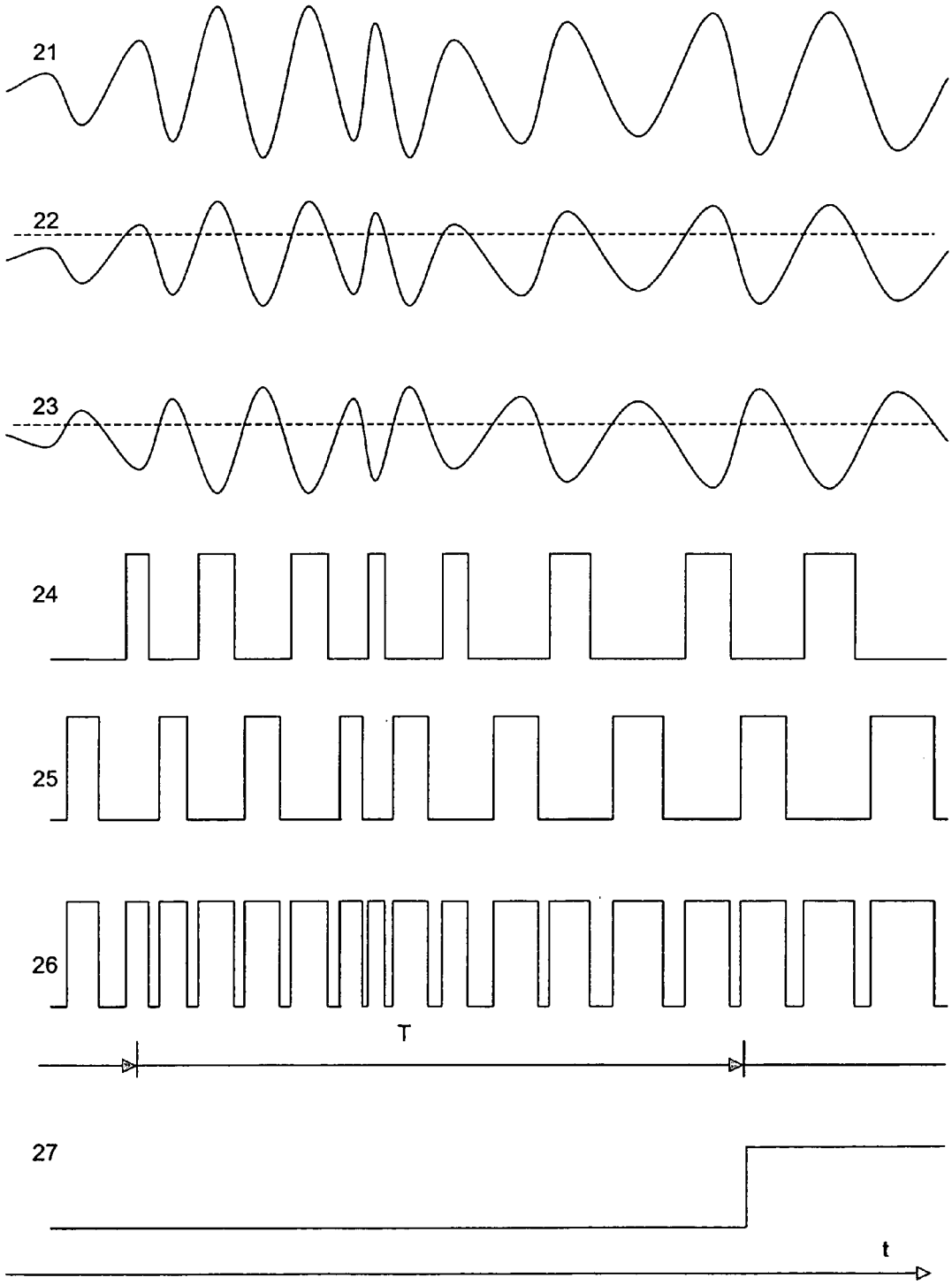
FIG. 3 shows signal waveforms within a circuit according to a preferred embodiment of the invention.

The signal lines of FIG. 2 are marked with reference numbers 21 to 27, and corresponding signal waveforms along a common time axis t are shown in FIG. 3. The input signal 21 is transmitted from the further multiplexer 11 to a variable gain amplifier 14 which normalises the amplitude levels of signals coming from different sources. The variable gain amplifier 14 generates a differential output signal 22. A first differential amplifier 16 is arranged to compare this differential output signal 22 to a reference signal generated by a reference signal source 15, generating a first comparator output 24 which has positive binary value if the amplitude of the differential output signal 22 exceeds the reference signal. A second differential amplifier 17 compares the inverted differential output signal 23 to the reference signal (or the differential output signal to the inverted reference signal) and generates second comparator output 25 which has a positive binary value if the amplitude of the inverted differential output signal exceeds the reference signal (or if the negative amplitude of the differential output signal exceeds the inverted reference signal). The output signals 24, 25 of the two differential amplifiers 16, 17 are combined by an OR-gate 18. The OR-combined signal 26 is fed to an integrator 19.

The integrator 19 determines whether the duty cycle, i.e. the relative time duration in which the OR-combined signal 26 is positive, exceeds, over a given period of time, or integration time T, a predetermined threshold. If this threshold is exceeded, then the integrator output 27 is set to represent a logical value of ON or True. The time T may be constant or be dynamically adapted by a learning algorithm. In a preferred embodiment of the invention, this is done by having a programmable counter circuit that is enabled only when the OR-combined signal 26 is in an ON or positive state. The counter frequency is suitably higher than typical frequencies of the audio input signals and the combined signal, for example on the order of 64 kHz.

The counter is periodically set back to zero, for example every 256 ms, whereby this integration time is predetermined, programmable and optionally adaptable parameter. Only if the counter reaches a predetermined threshold value is a relevant signal considered to be detected, and is a corresponding logical signal 27 transmitted to the demultiplexer 13.

In another preferred embodiment of the invention there is not necessarily a multiplexer 4 arranged between the signal sources 1, 2, 3 and an A/D converter 5. Instead, at least one signal source has an associated further A/D converter which directly receives the analog input signal of said source. As long as no relevant signal is detected in said analog input signal, the circuit elements corresponding to the further A/D converter are not provided with power and are not operational. In other words, a power supply to said circuit elements is interrupted. Only when a relevant signal is detected does the sniffer circuit 10 send a signal that causes the further A/D converter to be powered up. This causes the further A/D converter to generate a digital representation corresponding to said analog input signal and communicate it to the digital signal processor 6 as a new signal.

The digital signal processor 6 is simultaneously triggered by an interrupt generated by the sniffer circuit 10. This causes the digital signal processor 6 either to switch immediately to processing the new signal, or to first perform a classification of the new signal. During this classification, the new signal is preferably not transmitted to the output. Only if the classification determines that the new signal satisfies predetermined criteria that characterise e.g. speech or non-noise signals, is the new signal processed and included in the output. Accordingly, the multiplexer 4 may be also controlled by the digital signal processor 6.

The signal routing for selecting the desired input signal is then performed within the digital signal processor 6. If the signals are not combined, that is, if the previously active signal is disregarded, then the A/D converter 5 of the previously active signal is no longer needed and may be powered down.

Switching back to the original signal source, e.g. a microphone, takes place when either no relevant signal is received on the new signal, or when a relevant signal occurs on the original signal. If the original signal is not disregarded but combined with the new signal, then conversion and processing of the new signal is deactivated when it does not comprise a relevant signal for a predetermined period of time.

The sniffer circuit 10 and detection circuit 12 according to the invention as described above are preferably implemented in a mixed-signal integrated circuit, based e.g. on CMOS technology. This is preferable if other analog front-end signal conditioning and preprocessing means are implemented on such a mixed-signal circuit anyway, and the inventive circuits are then located on the same, already existing chip. However, under other circumstances it may be advantageous to obtain the same functionality by other implementation technologies and other circuit arrangements. For example, the OR-combined signal 27 as described could also be obtained by full-wave-rectification of the input signal and comparison with a given reference value by a Schmitt trigger. The integrated circuit could be replaced by essentially an RC-circuit. Such an implementation could be implemented by purely analog means, but would incur a larger silicon area, greater circuit design complexity and less precision.

A typical power consumption of the circuit according to the invention is on the order of 25 microamperes for the sniffer circuit 10 alone, whereas an additional A/D converter and pre-amplifier would draw approximately 90 microamperes.

While the invention has been described in present preferred embodiments of the invention, it is distinctly understood that the invention is not limited thereto, but may be otherwise variously embodied and practised within the scope of the claims.

LIST OF DESIGNATIONS

1 microphone
2 telecoil
3 audio input
4 multiplexer
5 analog-to-digital (A/D) converter
6 digital signal processor (DSP)
7 digital-to-analog (D/A) converter
8 output amplifier
9 speaker
10 sniffer circuit
11 further multiplexer
12 detection circuit
13 demultiplexer
14 variable gain amplifier
15 reference signal source
16, 17 differential amplifier
18 OR-gate

19 integrator
20 selection logic
21 input signal
22 differential input signal
23 inverted differential output signal
24 first comparator output
25 second comparator output
26 OR-combined signal 2
27 logical signal

The invention claimed is:

1. A hearing aid with detection and automatic selection of an input signal, comprising:

at least two analog input signal sources, at least one analog-to-digital converter for generating, from an analog input signal, a corresponding digital input signal, further processing means for digital processing of input signals, input signal routing means for selectively routing each one of one or more selected input signals to the further processing means, the input signal routing means being an analog input multiplexer, signal detection means configured to perform an analysis of the analog input signal and to control the signal routing means according to results of said analysis, signal detection means configured to analyse a single signal, and a further input multiplexer for alternately selecting one of the analog input signal sources and feeding the analog input signal to the signal detection means.

2. The hearing aid according to claim 1, configured to cause, when the signal detection means detects a relevant signal on a given analog input signal, an analog-to-digital converter to digitise said analog input signal and to transmit the corresponding digital input signal to the further processing means.

3. The hearing aid according to claim 2, wherein the analog input multiplexer selectively routes each one of one or more selected analog input signals to an associated analog-to-digital converter, and wherein the analog input multiplexer is configured to be controlled according to the results of the analysis of the signal detection means.

4. The hearing aid according to claim 2, configured to maintain circuitry associated with audio signal processing in a powered down state while the signal detection means does not detect a relevant signal, and to power up said circuitry if the signal detection means does detect a relevant signal on the analog input signal.

5. The hearing aid according to one of claims 1 to 3 and 4, wherein the signal detection means is configured to indicate the presence of a relevant signal in an input signal if an amplitude of the input signal exceeds a predetermined amplitude threshold during a predetermined minimum time within a predetermined time window.

6. The hearing aid according to one of claims 1 to 3 and 4, wherein the signal detection means are implemented by analog components or within a mixed-signal integrated circuit.

7. A method for detecting and automatically selecting an input signal in a hearing aid in which at least two analog input signals are available, comprising the steps of analysing the at least two analog input signals and detecting, for each of the at least two analog input signals, whether it comprises a relevant signal, the analysing being accomplished by providing a single detection circuit through a further input multiplexer alternately with each of the at least two analog input signals, selecting, according to results of said analysing, at least one selected input signal that comprises a relevant signal for further processing, and controlling a signal routing means to selectively route each one of the at least one selected input signal to further processing means, the signal routing means being an analog input multiplexer.

8. The method according to claim 7, further comprising the step of causing, when a signal detection means detects a relevant signal on a given analog input signal, an analog-to-digital converter to digitise said given analog input signal and to transmit a resulting digital input signal to the further processing means.

9. The method according to claim 8, further comprising the step of controlling, according to the results of said analysing of the signal detection means, an analog input multiplexer to forward each one of the at least one selected input signal to an associated analog-to-digital converter.

10. The method according to claim 8, comprising the further step of maintaining circuitry associated with audio signal processing in a powered down state while the signal detection means does not detect a relevant signal, and powering up said circuitry if the signal detection means does detect a relevant signal on an analog input signal.

11. The method according to one of claims 9 and 10, further comprising the steps of determining whether the amplitude of the input signal exceeds a predetermined amplitude threshold during a predetermined minimum time within a predetermined time window, and indicating the presence of a relevant signal in the input signal if this is the case.

12. The method according to one of claims 9 and 10, wherein the step of detecting whether an analog input signal comprises a relevant signal involves analog comparison operations of the analog input signal or of analog signals derived from the analog input signal to analog reference signals.

* * * * *

UNITED STATES PATENT AND TRADEMARK OFFICE

CERTIFICATE OF CORRECTION

PATENT NO. : 7,319,768 B2
APPLICATION NO. : 10/801785
DATED : January 15, 2008
INVENTOR(S) : Gerard van Oerle It is certified that error appears in the above-identified patent and that said Letters Patent is hereby corrected as shown below:

Column 7, Line 50, delete -- 4 --
and insert therefor -- 5 --

Column 7, Line 56, delete -- 4 --
and insert therefor -- 5 --

Column 8, Line 37, delete -- and 10 --
and insert therefor -- to 11 and 13 --

Column 8, Line 45, delete -- and 10 --
and insert therefor -- to 11 and 13 --

Signed and Sealed this

Twenty-seventh Day of May, 2008

JON W. DUDAS
*Director of the United States Patent and Trademark Office*